US010968777B2

(12) United States Patent
Propheter-Hinckley et al.

(10) Patent No.: US 10,968,777 B2
(45) Date of Patent: Apr. 6, 2021

(54) CHORDAL SEAL

(71) Applicant: United Technologies Corporation, Farmington, CT (US)

(72) Inventors: Tracy A. Propheter-Hinckley, Rocky Hill, CT (US); Kyle J. Brevick, Windsor, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 267 days.

(21) Appl. No.: 16/393,205

(22) Filed: Apr. 24, 2019

(65) Prior Publication Data

US 2020/0340405 A1 Oct. 29, 2020

(51) Int. Cl.

| | |
|---|---|
| ***F01D 25/24*** | (2006.01) |
| ***F01D 11/00*** | (2006.01) |
| *F01D 9/00* | (2006.01) |
| *F01D 9/02* | (2006.01) |
| *F01D 9/04* | (2006.01) |

(52) U.S. Cl.

CPC ..... *F01D 25/246* (2013.01); *F01D 11/005* (2013.01); *F01D 9/00* (2013.01); *F01D 9/02* (2013.01); *F01D 9/04* (2013.01); *F01D 9/041* (2013.01); *F05D 2220/32* (2013.01); *F05D 2240/12* (2013.01); *F05D 2240/55* (2013.01)

(58) Field of Classification Search

CPC ..... F01D 11/005; F01D 25/246; F01D 9/04; F01D 9/02; F01D 9/00; F01D 9/041; F05D 2240/55

See application file for complete search history.

(56) References Cited

U.S. PATENT DOCUMENTS

| | | | | | |
|---|---|---|---|---|---|
| 3,843,279 | A * | 10/1974 | Crossley | F01D 9/042 | 415/191 |
| 3,909,155 | A * | 9/1975 | Whinfrey | F01D 9/042 | 415/138 |
| 4,863,343 | A * | 9/1989 | Smed | F01D 9/042 | 415/138 |
| 5,149,250 | A * | 9/1992 | Plemmons | F01D 9/042 | 415/209.2 |

(Continued)

FOREIGN PATENT DOCUMENTS

| | | | | |
|---|---|---|---|---|
| EP | 3043361 | | 7/2016 | |
| EP | 3054099 | A2 * | 8/2016 | G06F 30/17 |

(Continued)

OTHER PUBLICATIONS

EP Extended Search Report for EP Application No. 20169273.8 dated Sep. 3, 2020.

*Primary Examiner* — Ninh H. Nguyen
*Assistant Examiner* — Brian Christopher Delrue
(74) *Attorney, Agent, or Firm* — Carlson, Gaskey & Olds, P.C.

(57) ABSTRACT

A vane for a gas turbine engine includes at least one airfoil. A first platform has a first rail located at a first end of the airfoil. A second platform has a second rail located at a second end of the airfoil. A first chordal seal is located on an axially aft surface of the first rail. A second chordal seal is located on an aft surface of the second rail and has a second radius of curvature at least partially truncated by an outer edge of the second rail.

18 Claims, 3 Drawing Sheets

(56) References Cited

U.S. PATENT DOCUMENTS 5,839,878 A * 11/1998 Maier ..... F01D 11/005 415/209.2
5,848,874 A * 12/1998 Heumann ..... F01D 9/042 415/189
6,164,908 A * 12/2000 Nishida ..... F02C 7/18 415/173.7
6,394,750 B1 * 5/2002 Hiskes ..... B23P 6/005 415/189
6,572,331 B1 * 6/2003 Mohammed-Fakir ..... F01D 11/005 415/191
6,599,089 B2 * 7/2003 Aksit ..... F01D 11/005 415/191
6,719,295 B2 * 4/2004 Mohammed-Fakir ..... F01D 11/005 277/411
6,935,836 B2 * 8/2005 Ress, Jr. ..... F01D 11/16 415/173.2
6,951,447 B2 * 10/2005 Cherolis ..... F01D 5/141 416/193 A
7,963,742 B2 * 6/2011 Clouse ..... F01D 5/16 415/160
8,070,427 B2 * 12/2011 Snook ..... F01D 11/005 415/191
8,356,981 B2 * 1/2013 Cooke ..... F01D 9/042 416/214 A
8,360,716 B2 * 1/2013 Bergman ..... F01D 9/02 415/190
8,403,645 B2 * 3/2013 Barnes ..... F01D 5/145 416/234
8,858,169 B2 * 10/2014 Dakowski ..... F01D 9/042 415/190
9,109,448 B2 * 8/2015 Ivakitch ..... F01D 9/042
9,863,259 B2 * 1/2018 Boeke ..... F01D 9/042
9,982,548 B2 * 5/2018 Ols ..... F01D 9/04
10,018,060 B2 * 7/2018 Helvaci ..... G06F 30/17
10,113,436 B2 * 10/2018 Rioux ..... F01D 9/00
10,329,937 B2 * 6/2019 Boeke ..... F02C 3/04
10,557,360 B2 * 2/2020 Boeke ..... F01D 9/041
2003/0123980 A1 * 7/2003 Mohammed-Fakir ..... F01D 11/005 415/191
2005/0244267 A1 * 11/2005 Coign ..... F01D 9/023 415/189
2006/0062673 A1 * 3/2006 Coign ..... F01D 21/045 416/214 A
2006/0099070 A1 * 5/2006 Suciu ..... F01D 5/066 415/199.5
2009/0110549 A1 * 4/2009 Snook ..... F01D 11/005 415/191
2011/0008156 A1 * 1/2011 Prentice ..... F01D 9/042 415/200
2011/0236199 A1 * 9/2011 Bergman ..... F01D 11/005 415/208.1
2015/0300185 A1 * 10/2015 Helvaci ..... G06F 30/17 415/191
2016/0333712 A1 * 11/2016 Boeke ..... F01D 11/006
2017/0268364 A1 * 9/2017 McCaffrey ..... F01D 5/284
2018/0283191 A1 * 10/2018 Helvaci ..... F01D 9/041

FOREIGN PATENT DOCUMENTS

EP 3054099 A3 * 11/2016 ..... F01D 9/041
EP 3093445 11/2016
EP 3054099 B1 * 8/2017 ..... F01D 9/041
EP 3244019 A1 * 11/2017 ..... G06F 30/17
EP 3244019 B1 * 5/2020 ..... F01D 9/041

* cited by examiner

CHORDAL SEAL

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

Gas turbine stator vane assemblies typically include a plurality of vane segments which collectively form the annular vane assembly. Each vane segment includes one or more airfoils extending between an outer platform and an inner platform. The inner and outer platforms collectively provide radial boundaries to guide core gas flow past the airfoils. Core gas flow may be defined as gas exiting the compressor passing directly through the combustor and entering the turbine.

Vane support rings support and position each vane segment radially inside of the engine diffuser case. In most instances, cooling air bled off of the fan is directed into an annular region between the diffuser case and an outer case, and a percentage of compressor air is directed in the annular region between the outer platforms and the diffuser case, and the annular region radially inside of the inner platforms.

The fan air is at a lower temperature than the compressor air, and consequently cools the diffuser case and the compressor air enclosed therein. The compressor air is at a higher pressure and lower temperature than the core gas flow which passes on to the turbine. The higher pressure compressor air prevents the hot core gas flow from escaping the core gas flow path between the platforms. The lower temperature of the compressor flow keeps the annular regions radially inside and outside of the vane segments cool relative to the core gas flow.

SUMMARY

In one exemplary embodiment, a vane for a gas turbine engine includes at least one airfoil. A first platform has a first rail located at a first end of the airfoil. A second platform has a second rail located at a second end of the airfoil. A first chordal seal is located on an axially aft surface of the first rail. A second chordal seal is located on an aft surface of the second rail and has a second radius of curvature at least partially truncated by an outer edge of the second rail.

In a further embodiment of any of the above, the outer edge of the second rail that at least partially truncated the second chordal seal is a radially inner edge of the second rail.

In a further embodiment of any of the above, the radially inner edge at least partially defines a radially innermost surface on the second rail.

In a further embodiment of any of the above, the first rail includes a first plateau on the axially aft surface that is located radially outward from the first chordal seal. The first chordal seal includes a first radius of curvature.

In a further embodiment of any of the above, the first rail includes a second plateau on the axially aft surface located radially inward from the first chordal seal. The first plateau is axially offset from the second plateau.

In a further embodiment of any of the above, a radially outer edge of the first chordal seal is connected with the first plateau by a first fillet. A radially inner edge of the first chordal seal is connected with the second plateau by a second fillet.

In a further embodiment of any of the above, the second rail includes a first plateau on the axially aft surface of the second rail located radially outward from the second chordal seal.

In a further embodiment of any of the above, a radially inner edge of the second chordal seal at least partially defines a radially inner edge of the second rail.

In a further embodiment of any of the above, a downstream most point on the first chordal seal is located axially aft of a downstream most point on the second chordal seal.

In a further embodiment of any of the above, the first radius of curvature is equal to the second radius of curvature.

In another exemplary embodiment, a gas turbine engine includes a compressor section upstream of a combustor section. A turbine section is located downstream of the combustor section. At least one of the turbine section or the compressor section includes a vane that has at least one airfoil. A first platform has a first rail located at a first end of the airfoil. A second platform has a second rail located at a second end of the airfoil. A first chordal seal is located on an axially aft surface of the first rail. A second chordal seal is located on an aft surface of the second rail and has a second radius of curvature at least partially truncated by an outer edge of the second rail.

In a further embodiment of any of the above, the outer edge of the second rail that at least partially truncated the second chordal seal is a radially inner edge of the second rail.

In a further embodiment of any of the above, the radially inner edge at least partially defines a radially innermost surface on the second rail.

In a further embodiment of any of the above, the first rail includes a first plateau on the axially aft surface located radially outward from the first chordal seal. The first chordal seal includes a first radius of curvature.

In a further embodiment of any of the above, the first rail includes a second plateau on the axially aft surface located radially inward from the first chordal seal. The first plateau is axially offset from the second plateau.

In a further embodiment of any of the above, a radially outer edge of the first chordal seal is connected with the first plateau by a first fillet. A radially inner edge of the first chordal seal is connected with the second plateau by a second fillet.

In a further embodiment of any of the above, the second rail includes a first plateau on the axially aft surface of the second rail located radially outward from the second chordal seal.

In a further embodiment of any of the above, a radially inner edge of the second chordal seal at least partially defines a radially inner edge of the second rail.

In a further embodiment of any of the above, a downstream most point on the first chordal seal is located axially aft of a downstream most point on the second chordal seal.

In a further embodiment of any of the above, the first radius of curvature is equal to the second radius of curvature.

DETAILED DESCRIPTION

Figure 1:
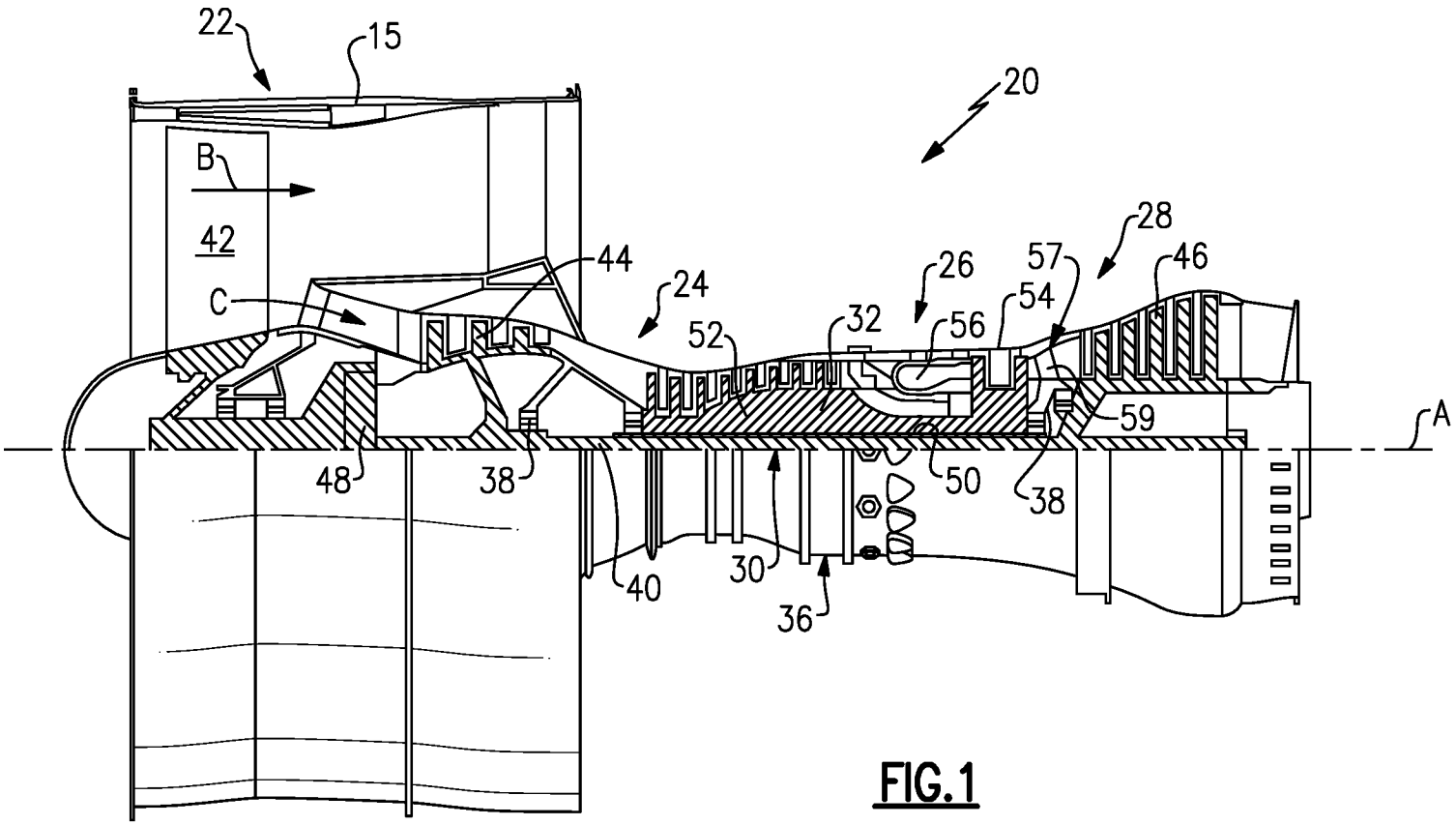
FIG. 1 is a schematic view of an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
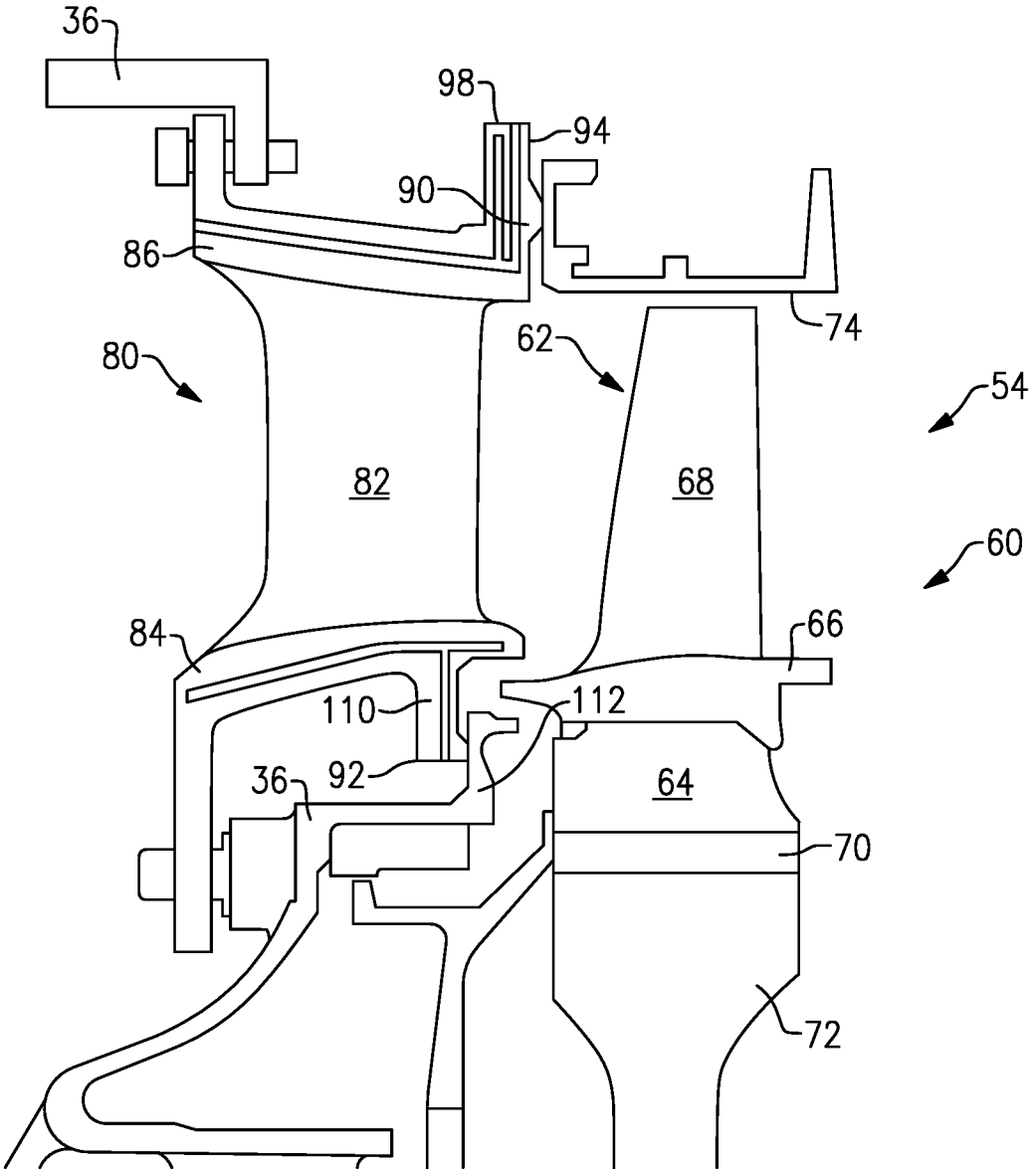
FIG. 2 is a cross-sectional view of a turbine section of the example gas turbine engine of FIG. 1.

FIG. 2 illustrates an enlarged schematic view of the high pressure turbine 54, however, other sections of the gas turbine engine 20 could benefit from this disclosure. In the illustrated example, the high pressure turbine 54 includes a one-stage turbine section with a first rotor assembly 60. In another example, the high pressure turbine 54 could include a two-stage high pressure turbine section.

The first rotor assembly 60 includes a first array of rotor blades 62 circumferentially spaced around a first disk 72. Each of the first array of rotor blades 62 includes a first root portion 64, a first platform 66, and a first airfoil 68. Each of the first root portions 64 is received within a respective first rim 70 of the first disk 72. The first airfoil 68 extends radially outward toward a first blade outer air seal (BOAS) assembly 74.

The first array of rotor blades 62 are disposed in the core flow path that is pressurized in the compressor section 24 then heated to a working temperature in the combustor section 26. The first platform 66 separates a gas path side inclusive of the first airfoils 68 and a non-gas path side inclusive of the first root portion 64.

An array of vanes 80 are located axially upstream of the first array of rotor blades 62. Each of the array of vanes 80 include at least one airfoil 82 that extends between a respective vane inner platform 84 and a vane outer platform 86. In another example, each of the array of vanes 80 include at least two airfoils 82 forming a vane doublet. The vane outer platform 86 of the vane 80 may at least partially engage the BOAS 74.

Figure 3:
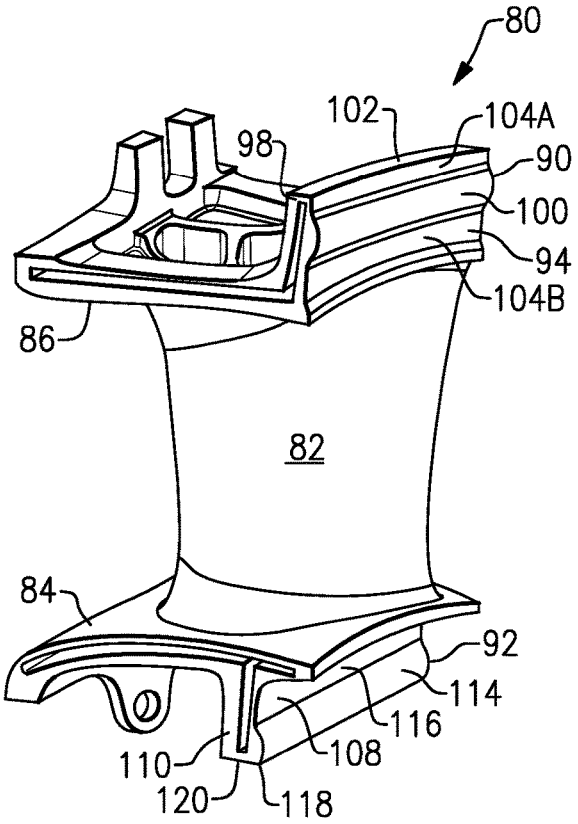
FIG. 3 is a perspective view of an example vane.
Figure 4:
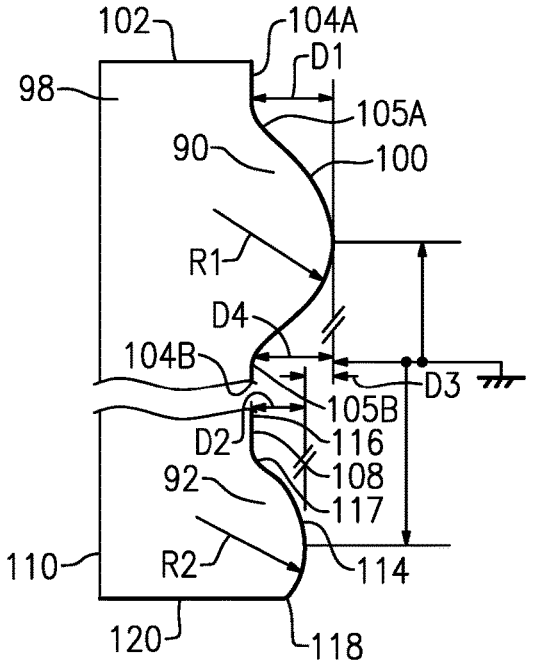
FIG. 4 schematically illustrates dimensions of chordal seals.

As shown in FIGS. 2-4, the vane 80 includes an outer chordal seal 90 and an inner chordal seal 92 located on a respective outer rail 98 and inner rail 110. The outer chordal seal 90 creates a seal between the vane 80 and the BOAS 74 and the inner chordal seal 92 creates a seal between the vane 80 and a portion of the static structure 36. In this disclosure, radial or radially and axial or axially extending is in relation to the axis A of the gas turbine engine 20.

In the illustrated example, the outer chordal seal 90 extends in a chordal direction along an axially aft facing surface 94 on the outer rail 98. The outer rail 98 is located adjacent an aft portion of the vane 80 and extends radially outward from the vane outer platform 86. The outer chordal seal 90 extends linearly between circumferential sides of the outer rail 98.

The outer chordal seal 90 includes an axially downstream facing surface 100 that includes a radius of curvature RE The surface 100 is spaced from a radially outer edge 102 of the outer rail 98 by a first plateau 104A. The first plateau 104A is a flat surface having a radius of curvature approaching infinity. A second plateau 104B is located radially inward from the surface 100 and spaces the outer chordal seal 90 from the radially outer platform 86. The second plateau 104B is also a flat surface having a radius of curvature approaching infinity.

In the illustrated example, the surface 100 is connected to the first plateau 104A with a first fillet 105A and the surface 100 is connected to the second plateau 104B with a second fillet 105B. A center or downstream most point of the surface 100 on the outer chordal seal 90 is spaced an axial distance D1 from the first plateau 104A and an axial distance D4 from the second plateau 104B. The distance D4 is greater than the distance D1 such that the second plateau 104B is axially upstream of the first plateau 104A to allow for greater rotation of the vane 80 without contacting the blade outer air seal 74. The outer chordal seal 90 is also linear such that it does not follow a curvature of the radially outer edge 102.

The inner chordal seal 92 creates a seal between the vane 80 and a portion of the static structure 36. The inner chordal seal 92 extends in a chordal direction along an axially aft facing surface 108 of the inner rail 110. The inner rail 110 is located adjacent an aft portion of the vane 80 and extends radially inward from the vane inner platform 84. The inner chordal seal 92 extends linearly between opposing circumferential sides of the inner rail 110.

In the illustrated example, the portion of the static structure 36 creating the seal with the inner chordal seal 92 is a flange 112 on a tangent on board injector (TOBI). However, another portion of the static structure 36 could be used to engage the inner chordal seal 92. The inner chordal seal 92 includes an axially downstream facing surface 114 that includes a radius of curvature R2. In one example, the radius of curvature R1 is equal to the radius of curvature R2 and in another example, the radius of curvature R1 is different from the radius of curvature R2. The variation of radius of curvature between R1 and R2 can accommodate variations in rotation of the vane 80 during operation of the gas turbine engine 20 as will be discussed further below.

The surface 114 is spaced from the inner platform 84 by an outer plateau 116 on the axially aft facing surface 108 of the inner rail 110. The outer plateau 116 is a flat surface having a radius of curvature approaching infinity. A center or downstream most point of the surface 114 on the chordal seal 92 is spaced an axial distance D2 from the outer plateau 116. The center or downstream most point on the surface 114 is spaced a distance D3 axially upstream of the center or downstream most point on the surface 100. The axially facing surface 114 is truncated by a radially inner edge 118 of the inner rail 110. The radially inner edge 118 at least partially defines a radially innermost surface 120 on the inner rail 110. Because the axially facing surface 114 of the inner chordal seal 92 is truncated by radially inner edge 118, the surface 114 at the radially inner edge 118 is axially downstream of the surface 114 at the outer plateau 116. Additionally, the surface 114 can be connected to the outer plateau 116 by a fillet 117.

Figure 5:
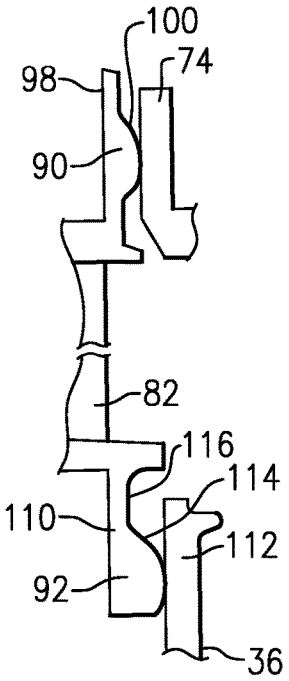
FIG. 5 illustrates the vane of FIG. 3 in a first orientation.
Figure 6:
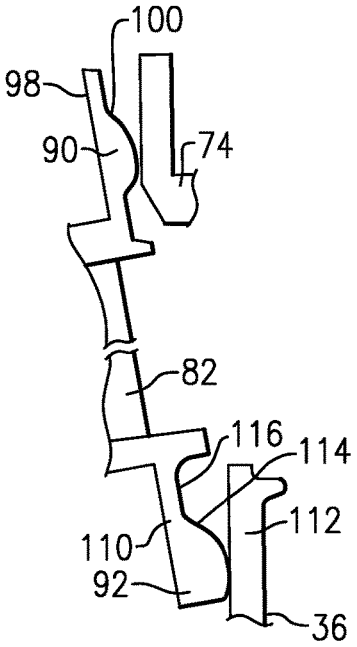
FIG. 6 illustrates the vane of FIG. 3 in a second orientation.

During operation of the gas turbine engine 20, the inner rail 110 can shift axially relative to the outer rail 98 as shown in FIGS. 5 and 6. Because the inner chordal seal 92 and the outer chordal seal 90 each include a radius of curvature, the outer and inner chordal seals 90, 92 roll and maintain a line of contact on the blade outer air seal 74 and the portion of the static structure 36. Because inner chordal seal 92 includes a radius of curvature that is truncated at the radially inner end of the inner rail 110, the inner rail 110 is able to rotate more without contacting an additional structure in the gas turbine engine 20 that would break the seal between the surface 114 and a portion of the engine static structure 36. Additionally, truncating the radius of curvature R2 on the inner chordal seal 92 reduces extra weight in the vane 80 that is not necessary to maintain a proper seal with the portion of the engine static structure 36.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A vane for a gas turbine engine comprising;

at least one airfoil;

a first platform having a first rail located at a first end of the airfoil;

a second platform having a second rail located at a second end of the airfoil;

a first chordal seal located on an axially aft surface of the first rail; and a second chordal seal located on an axially aft surface of the second rail having a second radius of curvature at least partially truncated by an outer edge of the second rail;

wherein the first rail includes a radially outermost edge extending along a curvature, a first plateau on the axially aft surface that is located radially outward from the first chordal seal with the first plateau extending between a first circumferential edge and a second circumferential edge, and the first chordal seal includes a first radius of curvature and the first and second chordal seal extend in a linear direction.

2. The vane of claim 1, wherein the outer edge of the second rail that at least partially truncated the second chordal seal is a radially inner edge of the second rail.

3. The vane of claim 2, wherein the radially inner edge at least partially defines a radially innermost surface on the second rail.

4. The vane of claim 1, wherein the first rail includes a second plateau on the axially aft surface located radially inward from the first chordal seal with the second plateau extending between the first circumferential edge and second circumferential edge, and the first plateau is axially offset from the second plateau.

5. The vane of claim 4, wherein a radially outer edge of the first chordal seal is connected with the first plateau by a first fillet and a radially inner edge of the first chordal seal is connected with the second plateau by a second fillet.

6. The vane of claim 2, wherein the second rail includes a first plateau on the axially aft surface of the second rail located radially outward from the second chordal seal.

7. The vane of claim 6, wherein a radially inner edge of the second chordal seal at least partially defines a radially inner edge of the second rail.

8. The vane of claim 1, wherein a downstream most point on the first chordal seal is located axially aft of a downstream most point on the second chordal seal.

9. The vane of claim 1, wherein the first radius of curvature is equal to the second radius of curvature.

10. A gas turbine engine comprising:

a compressor section upstream of a combustor section;

a turbine section located downstream of the combustor section, and at least one of the turbine section or the compressor section includes a vane having:

at least one airfoil a first platform having a first rail located at a first end of the airfoil;

a second platform having a second rail located at a second end of the airfoil;

a first chordal seal located on an axially aft surface of the first rail; and a second chordal seal located on an axially aft surface of the second rail having a second radius of curvature at least partially truncated by an outer edge of the second rail;

wherein the first rail includes a radially outermost edge extending along a curvature, a first plateau on the axially aft surface that is located radially outward from the first chordal seal with the first plateau extending between a first circumferential edge and a second circumferential edge of the first rail and the first chordal seal includes a first radius of curvature and the first chordal seal engages a blade outer air seal.

11. The gas turbine engine of claim 10, wherein the outer edge of the second rail that at least partially truncated the second chordal seal is a radially inner edge of the second rail and the first chordal seal and the second chordal seal extend in a linear direction.

12. The gas turbine engine of claim 11, wherein the radially inner edge at least partially defines a radially innermost surface on the second rail.

13. The gas turbine engine of claim 10, wherein the first rail includes a second plateau on the axially aft surface located radially inward from the first chordal seal with the second plateau extending between the first circumferential edge of the first rail and the second circumferential edge of the first rail and the first plateau is axially offset from the second plateau.

14. The gas turbine engine of claim 13, wherein a radially outer edge of the first chordal seal is connected with the first plateau by a first fillet and a radially inner edge of the first chordal seal is connected with the second plateau by a second fillet.

15. The gas turbine engine of claim 10, wherein the second rail includes a first plateau on the axially aft surface of the second rail located radially outward from the second chordal seal.

16. The gas turbine engine of claim 15, wherein a radially inner edge of the second chordal seal at least partially defines a radially inner edge of the second rail.

17. The gas turbine engine of claim 10, wherein a downstream most point on the first chordal seal is located axially aft of a downstream most point on the second chordal seal.

18. The gas turbine engine of claim 10, wherein the first radius of curvature is equal to the second radius of curvature.

* * * * *